United States Patent [19]

Barker et al.

[11] Patent Number: 4,766,457

[45] Date of Patent: Aug. 23, 1988

[54] PARTICULATE MATERIAL DISPENSER

[75] Inventors: Laurence S. Barker; Dan A. Hays, both of Fairport; Thomas P. Redding, Penfield; William H. Wayman, Ontario, all of N.Y.

[73] Assignee: Xerox Corporation, Stamford, Conn.

[21] Appl. No.: 92,109

[22] Filed: Sep. 2, 1987

[51] Int. Cl.[4] ..... G03G 15/08

[52] U.S. Cl. ..... 355/3 DD; 355/14 D; 118/657

[58] Field of Search ..... 355/3 DD, 14 D, 3 R; 118/653, 640

[56] References Cited

U.S. PATENT DOCUMENTS

| | | | |
|---|---|---|---|
| 4,011,835 | 3/1977 | Lewis | 118/652 |
| 4,270,487 | 6/1981 | Terashima et al. | 118/690 |
| 4,324,483 | 4/1982 | Tagawa et al. | 355/3 DD |
| 4,353,637 | 10/1982 | Parker | 355/3 DD |
| 4,417,802 | 11/1983 | Forbes II | 355/3 DD |
| 4,647,180 | 3/1987 | Watanabe | 355/3 DD |

*Primary Examiner*—A. C. Prescott

[57] ABSTRACT

Apparatus for dispensing particulate material has a substantially enclosed rigid housing with longitudinally disposed walls and parallel side walls having an opening in the housing for dispensing particulate material therefrom and a flexible sheet-like inner liner conformable to at least some of the longitudinal walls of the housing, one end of which is attached to a portion of the housing the other end of which is attached to a take-up roll for the inner liner which conforms to the longitudinal walls when the housing is filled with particulate material. The portion of the housing to which the inner liner is attached, the take-up roll and the dispensing opening are disposed relative to each other such that as the sheet-like inner liner is taken up by the take-up roll the particulate material is transported by the inner liner toward the dispensing opening and dispensed therethrough. In a preferred embodiment, the particulate dispenser is a developer housing for an electrostatographic printing machine.

21 Claims, 3 Drawing Sheets

PARTICULATE MATERIAL DISPENSER

BACKGROUND OF THE INVENTION

The present invention relates to apparatus for dispensing particulate material and in particular to a developer apparatus for applying toner material to the surface of an imaging member in an electrostatographic reproducing apparatus.

In an electrostatographic reproducing apparatus commonly in use today, a photoconductive insulating member is typically charged to uniform potential and thereafter exposed to a light image of an original document to be reproduced. The exposure discharges the photoconductive insulating surface in exposed or background areas and creates an an electrostatic latent image on the member which corresponds to the image areas contained within the usual document. Subsequently, the electrostatic latent image on the photoconductive insulating surface is made visible by developing the image with developing powder referred to in the art as toner. Most development systems employ a developer material which comprises both charged carrier particles and charged toner particles which triboelectrically adhere to the carrier particles. During development the toner particles are attracted from the carrier particles by the charge pattern of the image areas in the photoconductive insulating area to form a powder image on the photoconductive area. Alternatively, single component development systems may be employed which utilize only toner particles. The developed image may subsequently be transferred to a support surface such as copy paper to which it may be permanently affixed by heating or by the application of pressure.

In most commercial applications the particulate toner material is contained in a sump and dispensed therefrom by gravity feeding. Typically this requires a fairly extensive vertical dimension for the toner sump and developer dispenser which is unacceptable in the design of compact automatic printing apparatus. Furthermore, with the emergence of the cartridge concept wherein one or more functional units of the electrostatographic reproducing apparatus such as the imaging member, developer housing, cleaner housing, and charge corotron may be included within a removable processing cartridge which may be discarded upon exhaustion of supply of developer, life of photoreceptor or filling of the cleaner sump and replaced with a new processing cartridge there are several architectural constraints on the design and placement of a toner sump. In these configurations, it is frequently desired to have a generally horizontally oriented toner sump and developer housing rather than the previously mentioned vertically oriented toner sump and developer housing. In such a housing, it is therefore necessary to physically transport toner from the sump portion to the developer housing. This is particularly important in those types of developing systems wherein it is necessary to maintain a supply of toner in a nip between a toner donor roll and a charge metering roll to supply an adequate quantity of charged toner to the imaging member during development. Paddle wheels have previously been employed to move toner in such a manner. However, they generally have been found to be inefficient in that they generally do not have access to the entire volume of the sump portion of the developer housing. Accordingly, there is a desire to provide a simple, inexpensive way to transport toner horizontally and efficiently in a developer housing.

PRIOR ART

U.S. Pat. No. 4,417,802 to Forbes II discloses a particle dispenser which delivers toner from the uppermost portion of the supply chamber, as opposed to from the bottom of the chamber, to a conveyor. The chamber consists of a rigid outer chamber and flexible inner container. A slidably mounted plate is located below the flexible inner container which automatically moves in a vertical direction to maintain a continuous supply of toner to the conveyor.

SUMMARY OF THE INVENTION

In a principle aspect of the present invention, an apparatus for dispensing particulate material comprising a substantially enclosed rigid housing with longitudinally disposed walls and parallel side walls has an opening therein for dispensing particulate material therefrom and is provided with a flexible sheet-like inner liner conformable to at least some of the longitudinal walls of the housing, one end of the inner liner being attached to a portion of the housing, the other end of the inner liner being attached to means for winding up the inner liner, the inner liner conforming to the longitudinal walls when the housing is filled particulate material. A portion of the housing to which the inner liner is attached, the means to wind up the inner liner and the dispensing opening are disposed relative to each other such that as the sheet-like inner liner is wound up by the winding means particulate material is transported by the sheet-like inner liner toward the opening and dispensed thereto.

In a further aspect of the present invention, the take-up roll for winding up the sheet-like inner liner is disposed in the upper portion of the housing, one end of the sheet-like inner liner is attached to a lower portion of the housing and the dispensing opening is in the lower portion of the housing.

In a further aspect of the present invention the ends of the flexible sheet-like inner liner are in continuous sealing engagement with a compliant foam seal on said parallel side walls of the housing as the liner is wound.

In a further aspect of the the present invention a take-up roll and a dispensing opening are disposed adjacent the same longitudinal wall of the housing and the one end of the inner liner is attached to the housing adjacent the dispensing opening whereby as said inner liner is wound particulate material may be transported vertically and horizontally to said dispensing opening.

In a further aspect of the present invention, the dispensing apparatus includes means to indicate the amount of particulate material remaining in the dispensing apparatus.

In a further aspect of the present invention, a developer apparatus for developing an electrostatic latent image on an imaging member is provided having a generally horizontally disposed toner sump as described above.

In a further aspect of the present invention, the developer apparatus includes a toner donor roll and a charging roller positioned in contact with donor roll defining a nip therebetween with toner particles being charged in the nip and the charging roller metering the quantity of toner particles move by the donor roller to the imaging member.

Other aspects of the present invention will become apparent as the following description proceed and upon references to the drawing.

DESCRIPTION OF THE PREFERRED EMBODIMENT

Figure 1:
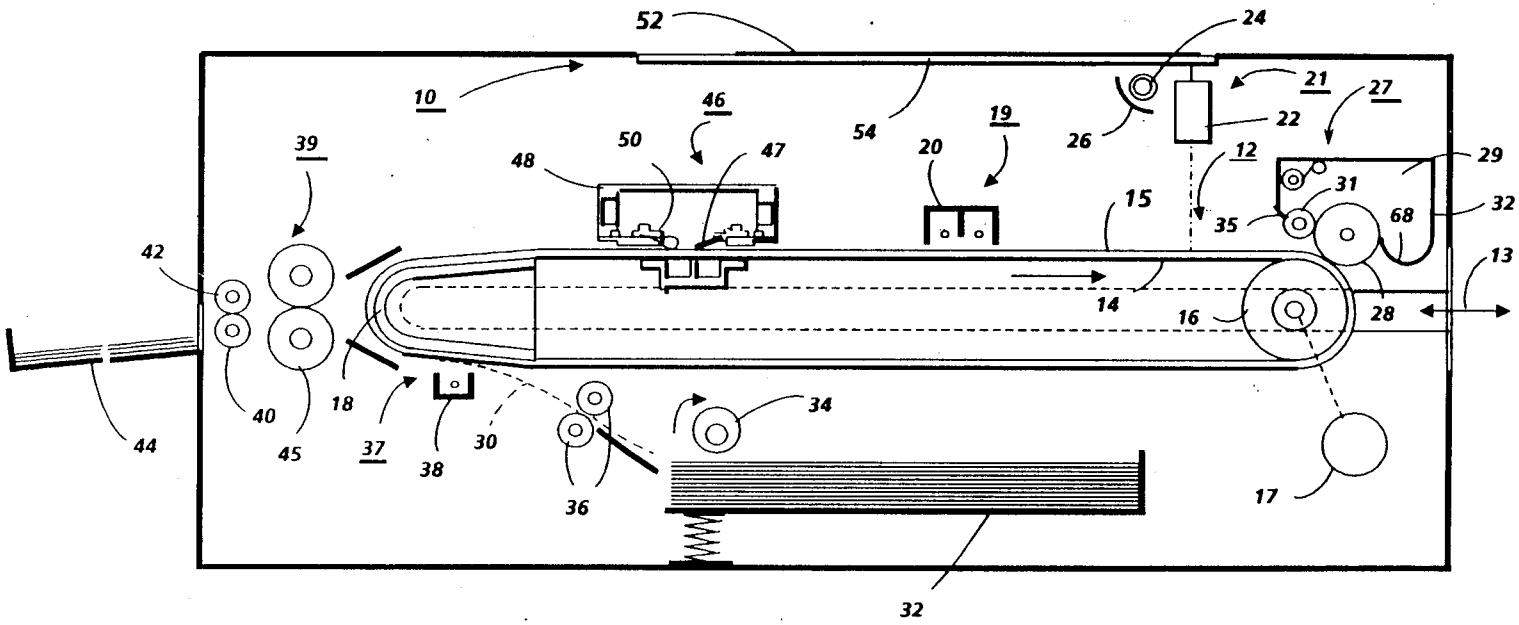
FIG. 1 is a schematic representation in cross section of an automatic electrostatographic printing machine with a developer housing according to the present invention.

In the drawings like reference numerals have been used throughout to designate identical elements. Referring now to FIG. 1, there is shown by way of example, an automatic electrostatographic reproducing machine 10 which includes a removable processing cartridge employing the developer apparatus according to the present invention. The reproducing machine depicted in FIG. 1 illustrates the various components utilized therein for producing copies from an original document. Although the apparatus of the present invention is particularly well adapted for use in automatic electrostatographic reproducing machines, it should become evident from the following description that it is equally well suited for use in a wide variety of processing systems including other systems such as printers and is not necessarily limited in application to the particular embodiment shown herein.

The reproducing machine 10 illustrated in FIG. 1 employs a removable processing cartridge 12 which may be inserted and withdrawn from the main machine frame in the direction of arrow 13. Cartridge 12 includes an image recording belt like member 14 the outer periphery of which is coated with a suitable photoconductive material 15. The belt is suitably mounted for revolution within the cartridge about driven transport roll 16, around belt tracking shoe 18 and travels in the direction indicated by the arrow on the inner run of the belt to bring the image bearing surface thereon past the plurality of xerographic processing stations. Suitable drive means such as motor 17 are provided to power and coordinate the motion of the various cooperating machine components whereby a faithful reproduction of the original input scene information is recorded upon a sheet of final support material 30, such as paper or the like.

Initially, the belt 14 moves the photoconductive surface 15 through a charging station 19 wherein the belt is uniformly charged with an electrostatic charge placed on the photoconductive surface by charge corotron 20 in known manner preparatory to imaging. Thereafter the belt 14 is driven to exposure station 21 wherein the charged photoconductive surface 15 is exposed to the light image of the original input scene information, whereby the charge is selectively dissipated in the light exposed regions to record the original input scene in the form of an electrostatic latent image. The exposure station 21 may comprise a bundle of image transmitting fiber lenses 22 produced under the tradename of "SELFOC" by Nippon Sheet Glass Company Limited, together with an illuminating lamp 24 and a reflector 26. After exposure of the belt 15 the electrostatic latent image recorded on the photoconductive surface 15 is transported to development station 27, wherein developer is applied to the photoconductive surface of the drum 15 rendering the latent image visible. Suitable development station could include a development system including toner developer donor roll 28, a toner supply reservoir 29 and a metering charging roller 31 contained within developer housing 32 with a flexible inner liner 68 contained therein 32 in a manner described in greater detail with reference to FIGS. 2–4.

Sheets 30 of the final support material are supported in a stack arrangement on elevated stack support tray 33. With the stack at its elevated position, the sheet separator segmented feed roll 34, feeds individual sheets therefrom to the registration pinch roll pair 36. The sheet is then forwareded to the transfer station 37 in proper registration with the image on the belt and the developed image on the photoconductive surface 15 is brought into contact with the sheet 30 of final support material within the transfer station 37 and the toner image is transferred from the photoconductive surface 15 to the contacting side of the final support sheet 30 by means of transfer corotron 38. Following transfer of the image, the final support material which may be paper, plastic, etc., as desired, is separated from the belt by the beam strength of the support material 30 as it passes around the arcuate face of the belt tracking shoe 18, with the sheet containing the toner image thereon which is advanced to fixing station 39 wherein roll fuser 40 fixes the transferred powder image thereto. After fusing the toner image to the copy sheet, the sheet 30 is advanced by output rolls 42 to sheet stacking tray 44.

Although a preponderance of toner powder is transferred to the final support material 30, invariably some residual toner remains on the photoconductive surface 15 after the transfer of the toner powder image to the final support material. The residual toner particles remaining on the photoconductive surface after the transfer operation are removed from the belt 14 by the cleaning station 46 which comprises a cleaning blade 47 in scrapping contact with the outer periphery of the belt 14 and contained within cleaning housing 48 which has a cleaning seal 50 associated with the upstream opening of the cleaning housing.

Normally when the copier is operated in the conventional mode, the original document 52 to be reproduced is placed image side down upon a horizontal transport viewing platen 54 which transports the original past the exposure station 21. The speed of the moving platen and the speed of the photoconductive belt are synchronized to provide a faithful reproduction of the original document.

It is believed that the foregoing general description is sufficient for the purposes of the present application to illustrate the general operation of an automatic xerographic copier 10 which can embody the apparatus in accordance with the present invention.

Figure 2:
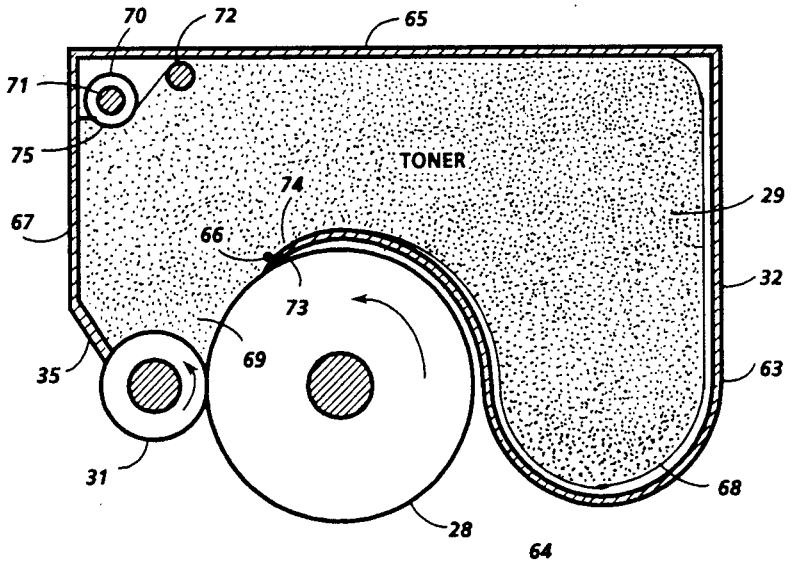
FIG. 2 is an enlarged schematic representation in cross section of the developer housing according to the present invention with a full toner sump.
Figure 3:
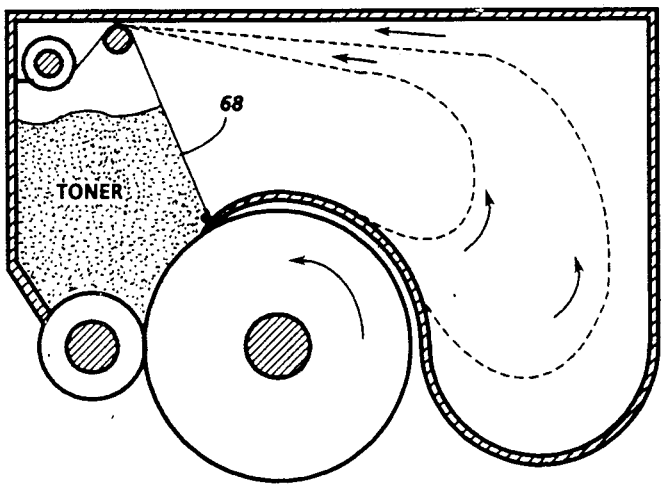
FIG. 3 is an enlarged schematic representation in cross section of the developer housing according to the present invention wherein the toner sump has been substantially depleted of toner.

Referring now to FIGS. 2 and 3, the developer apparatus will be described in greater detail. The developer station comprises a donor roll 28 which transports weakly charged insulating non-magnetic toner particles into contact with the electrostatic latent image recorded on the photoconductive surface of belt 14. Donor roll 28 rotates in the direction of the arrow. A toner particle supply reservoir 29 contained within developer housing 32 furnishes toner particles to the donor roll 28. A metering charging roller 31 contacts donor roll 28 to define a nip therebetween. Metering charging roller 31 rotates in the direction of the arrow as weakly charged toner particles on donor roll 28 pass through the nip between the metering charging roller 31 and the donor roll 28. As a result of the movement in opposite directions of metering charging roller and the donor roller, the toner particles in the nip acquire a charge thereon. These charged toner particles are then transported by the compliant donor roller 28 to the electrostatic latent image recorded on the photoconductive surface. The electrostatic latent image attracts the toner particles from the donor roller 28 to form a powder image on the photoconductive surface of belt 14. Doctor blade 35 has the free end thereof contacting metering charging roller 31 to act as a seal to prevent toner particles from advancing therebeyond.

Figure 4:
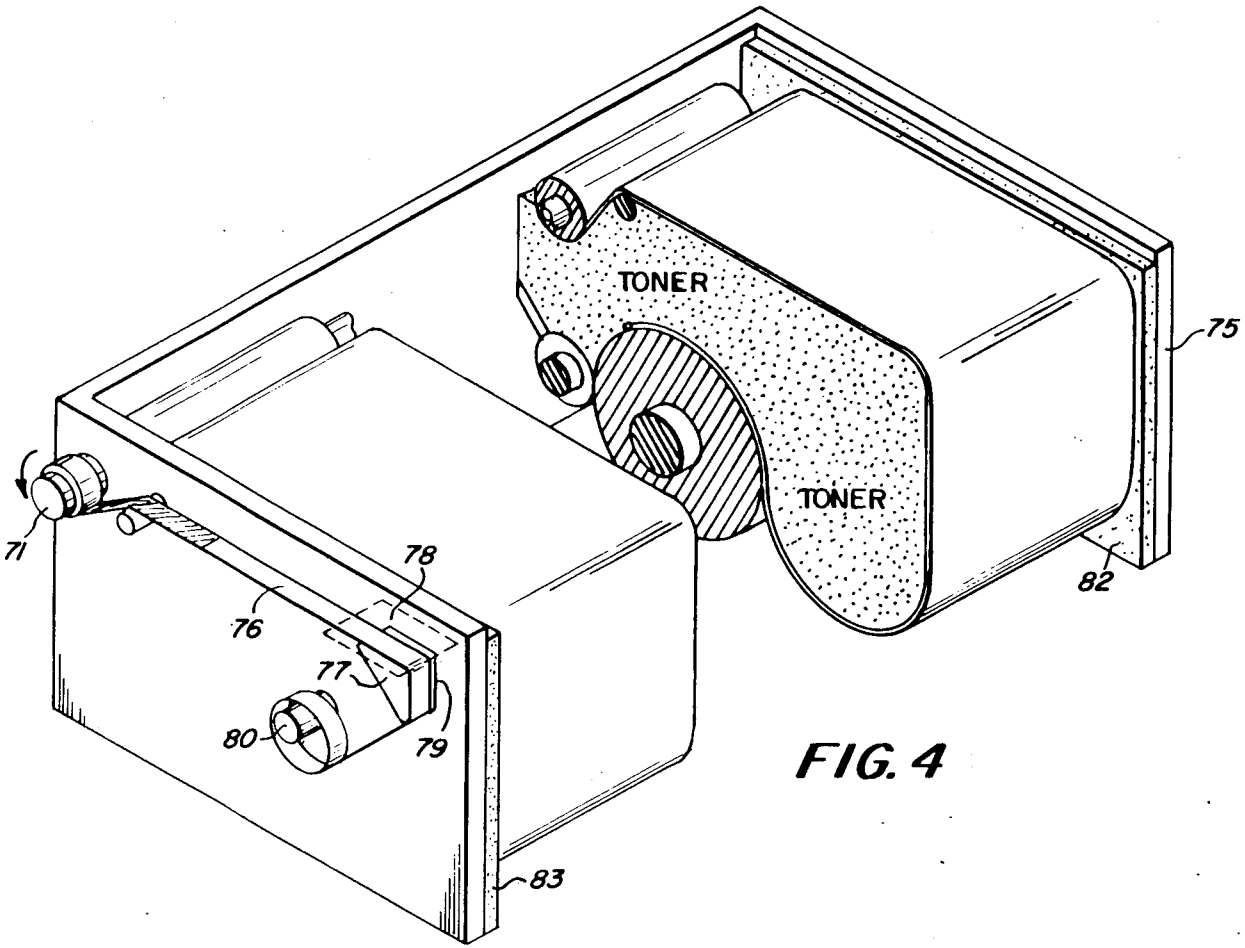
FIG. 4 is an isometric view partly in section of the developer housing according to the present invention illustrating the end sealing arrangements and the quantity indicator on the end of the developer housing.

With additional reference to FIG. 4, the toner removal according to the present invention will be described in greater deal. The developer housing 32 comprises longitudinally disposed walls 63, 65, and 67 with S-shaped portion 64 at the bottom of the otherwise generally rectangular cross sectional shape of the developer housing. A dispensing opening 69 is formed in the space between the end of the doctor blade 35 and the end of the S-shaped portion of the developer housing 73 for dispensing toner therefrom. Located below the concave portion of the S-shaped portion of the developer housing 73, is the donor roll 28 which is in sealing engagement with S-shaped portion of the developer housing by means of flap seals 66. Also, located within the dispensing opening is metering charging roller 31 forming a nip therebetween with donor roll 28 in the dispensing opening 69. A flexible sheet-like inner liner 68 has one end thereof 74 attached to the end of the S-shaped portion of the developer housing 73 and the other end 75 attached to take-up roll 70 rotatably mounted on take-up roll shaft 71. In FIG. 2, the developer housing is illustrated as being full of toner and the flexible sheet-like inner liner 68 conforms generally to the longitudinal walls of the housing and is supported at the upper portion thereof by support means such as rod or roll 72. During operation of the developer housing as, for example, in the the apparatus described with reference to FIG. 1, toner in the nip area between the donor roll and the charging metering roll is charged and delivered to the imaging member by the donor member. As toner is consumed or depleted in the supply reservoir, the flexible sheet like inner liner 68 is wound up by the take-up roll 70 to ensure a continuing supply of toner in the dispensing opening 69 above the donor roll 28 and charging metering roll 31. FIG. 3 illustrated the position of the flexible sheet-like inner liner when substantially all the toner has been dispensed from the developer housing and the sheet-like inner liner is taut between the S-shaped end portion 73 of the developer housing and the take-up roll 70. The dotted lines in FIG. 3 illustrate intermediate positions for the flexible sheet-like inner liner 68 during the dispensing process for the toner contained within the supply reservoir 29. During the consumption of toner from the supply reservoir 29 by gradually winding up the inner liner on the take-up roll, toner contained from the supply reservoir is continuously transported both horizontally and vertically from the entire reservoir to the dispensing opening 69. During this winding up operation, the support rod or roll 72 helps to ensure that the sheet-like inner liner remains outside the toner volume. During this operation, and as illustrated in FIG. 4 to ensure that all the toner is transported or moved from the supply reservoir into the dispensing opening, the side walls 75 and 77 which are parallel to each other are in sealing engagement with the moving flexible sheet-like inner liner by means of a compliant foam seals 82 and 83.

While the developer housing has been illustrated as a generally rectangular cross section having an S-shaped portion, it will be understood that it may take various other forms. The cross sectional shape may be any desired shape as long as the side walls 75 and 77 are parallel to each other so that as the inner liner is gradually wound up on the take up roll, the edges of the inner liner are in continuous sealing engagement with the parallel side walls. With respect to the cross sectional configuration of the developer chamber, it is only necessary that it be such to permit the flexible sheet-like inner liner to conform to the surface and be capable of being wound up on the take-up roll. In this way, the flexible sheet-like inner liner may be wound up very much like an ordinary window shade to provide the toner transport or mover function. Preferably, as illustrated the take-up roll is fixedly attached to the upper portion of the developer housing with one end of the inner liner attached thereto and the other end being attached to the S-shaped portion of the developer housing at a lower portion thereof and adjacent to the dispensing opening so that as the inner liner is wound up by the take-up roll, the toner is transported by the inner liner toward the dispensing opening and dispensed therethrough. This operation can be readily achieved by providing the take-up roll and a dispensing opening disposed adjacent the same longitudinal wall of the developer housing with the end of the inner liner attached to the housing adjacent the dispensing opening.

The flexible sheet-like inner liner may be made of any suitable material such as cloth, paper, sheet-like polymeric material as long as it is substantially impervious to the toner material. A particularly preferred material is a polyester film such as Mylar. While the flexible sheet-like inner liner or window shade is flexible in the winding direction, it should have sufficient beam strength so as not to collapse in the direction perpendicular to the winding direction. The continuous winding motion of the take-up roll 70 may be provided in any suitable way. It may, for example, be provided directly by the main machine drive in the automatic printing machine. Alternatively, it may be generated by the spring force of an internally mounted spring much like an ordinary window shape. In such configuration, the spring force is necessarily great when the toner housing is full of toner. During the winding up of the sheet-like liner as the load on the spring decreases, the spring force decreases to provide good balance and its own feedback as to when the take-up roll needs to be driven. Thus, as toner is consumed by the dispensing action between the donor roll and the charging metering roll, a small void is left in the supply reservoir on top of the dispensing opening and toner tends to collapse into the void as a result of the pressure on the toner pack on top of the dispensing opening created by the force of the take-up roll (window shade spring) which is greater than the resistance of the pack of toner to continuously move toner into the void as the inner liner is wound up. It may be desirable in some embodiments to provide a wire form anti-bridging device in the developer housing above the dispensing opening.

In manufacture, the developer housing together with the donor roll and a metering charging roll may be assembled in one unit with, for example, the top longitudinal wall 65 being a separate piece. Thereafter, the flexible sheet-like inner liner 68 may be placed in the developer housing affixed to the end 73 of the S-shaped portion and take-up roll 70 having the end of the inner liner affixed in position. The top longitudinal wall 65 may thereafter be fixed in place and toner inserted into the supply reservoir through one of the side walls 75 or 77.

FIG. 4, in addition to illustrating the foam seals 82 and 83 on side walls 75 and 77, illustrates a means to indicate the amount of toner remaining in the dispensing apparatus at any particular point in time. This indicating means comprises a coiled strip of paper or suitable plastic film which has been color coded to indicate when the toner supply has been depleted. One end of the coiled strip 76 is attached to the take-up roll shaft 71 outside the developer housing and is wound up on the take-up roll shaft as the inner liner or window shade is wound up on the interior of the developer housing of the take-up roll itself. The other end of the coiled strip is suitably positioned on the supply roll 80 and wrapped around a support member 77 passing through a window 78 located in a external cover 79 of the developer housing. The coiled strip may, for example, have sections in various colors indicating the general conditions with regard to the supply of toner in the developer housing. For example, green may indicate that it is from full to two-thirds full, yellow from two-thirds to one-third full, and red from one-third full to being empty.

Thus, according to the present invention, a simple inexpensive toner dispenser has been provided which is capable of transporting toner horizontally and/or vertically in situations where space constraints prevent gravity feed. In a particular embodiment, it provides a constantly available supply of toner in the nip between the donor roll and the metering charging roll. It further has the advantage in that it does not require a complex or expensive drive system in which the transport the toner.

The disclosures of the patents referred to herein are specifically and totally incorporated herein by reference.

While the invention has been described with reference to specific embodiments, it will be apparent to those skilled in the art that many alternatives, modifications and variations may be made. For example, while the invention has been illustrated with an electrostatic latent image formed by exposure of an electrically charged photoconductive member to light of an original document, the electrostatic latent image may alternatively be generated from information electronically stored or generated in digital form. Furthermore, while the invention has been illustrated with reference to toner dispensers, it has equal application as a developer dispenser in particular and any particulate material dispenser in general. Accordingly, it is intended to embrace all such alternatives, modifications that may fall within the spirit and scope of the appended claims.

We claim:

1. Apparatus for dispensing particulate material comprising a substantially enclosed rigid housing with longitudinally disposed walls and parallel side walls, an opening in said housing for dispensing particulate material therefrom, a flexible sheet-like inner liner conformable to at least some of the longitudinal walls of said housing, one end of said flexible sheet-like inner liner being fixedly attached to a portion of said housing, the other end of said flexible sheet-like inner liner being attached to means for winding said flexible sheet-like inner liner; said sheet-like inner liner conforming to said longitudinal walls when said housing is filled with particulate material, said portion of said housing, said winding means and said dispensing opening being disposed relative to each other such that as said sheet-like inner liner is wound by said winding means, particulate material is transported by said sheet like inner liner toward said opening and dispensed therethrough.

2. The apparatus of claim 1 wherein said winding means comprises a take-up roll fixedly disposed in the uppermost portion of said housing, said one end of said sheet-like inner liner is fixedly attached to a lower portion of said housing and said dispensing opening is in a lower portion of said housing.

3. The apparatus of claim 1 wherein the ends of said flexible sheet-like inner liner are in continuous sealing engagement with said parallel side walls of said housing as said liner is wound.

4. The apparatus of claim 3 wherein said sealing engagement is provided by a compliant foam seal fastened to each of said parallel side walls.

5. The apparatus of claim 2 further including support means adjacent said take-up roll in the uppermost portion of said housing to support said inner liner at the top of said housing.

6. The apparatus of claim 2 wherein said take-up roll and said dispensing opening are disposed adjacent the same longitudinal wall of said housing and said one end of said inner liner is attached to said housing adjacent said opening whereby as said inner liner is wound particulate material may be transported vertically and horizontally to said dispensing opening.

7. The apparatus of claim 1 further including a dispensing roll in said dispensing opening.

8. The apparatus of claim 1 wherein said flexible sheet-like inner liner is a polyester film.

9. The apparatus of claim 1 further including means to indicate the amount of particulate material remaining in the dispensing apparatus.

10. The apparatus of claim 9 wherein said indicating means comprises a coded film-like strip with visual indicia thereon movably mounted externally of one side wall of said housing, one end of said strip being attached to said winding means and thereby wound with said inner liner.

11. Developer apparatus for developing an electrostatic latent image on an imaging member comprising a substantially enclosed rigid developer housing with longitudinally disposed walls and parallel side walls, a longitudinal opening in said housing, a rotatable donor roll in said opening for transporting toner from said developer housing to said imaging member, a flexible sheet-like inner liner comformable to at least some of the longitudinal walls of said housing, one end of said flexible sheet-like inner liner being fixedly attached to a portion of said housing, the other end of said flexible sheet-like inner liner being attached to means for winding said flexible sheet-like inner liner, said sheet-like inner liner conforming to said longitudinal walls when said housing is filled with toner; said portion of said housing, said winding means and said dispensing opening being disposed relative to each other such that as said sheet-like inner liner is wound by said winding means, toner is transported by said sheet-like inner liner toward said donor roll and therefrom to said imaging member.

12. The developer apparatus of claim 11 including a charging roller positioned in contact with said donor roll defining a nip therebetween with toner particles being charged in the nip.

13. The developer apparatus of claim 12 wherein said charging roller meters the quantity of toner particles transported by said donor roller to said imaging member.

14. The developer apparatus of claim 11 wherein said winding means comprises a take-up roll fixedly disposed in the uppermost portion of said housing, said one end of said sheet-like inner liner is fixedly attached to a lower portion of said housing and said longitudinal opening is in a lower portion of said housing.

15. The developer apparatus of claim 11 wherein the ends of said flexible sheet-like inner liner are in continuous sealing engagement with said parallel side walls of said housing as said liner is wound.

16. The developer apparatus of claim 15 wherein said sealing engagement is provided by a foam seal fastened to each of said parallel side walls.

17. The developer apparatus of claim 14 further including support means adjacent said take-up roll in the uppermost portion of said housing to support said inner liner at the top of said housing.

18. The developer apparatus of claim 14 wherein said take-up roll and said dispensing opening are disposed adjacent the same longitudinal wall of said housing and said one end of said inner liner is attached to said housing adjacent said opening whereby as said inner liner is wound toner may be transported vertically and horizontally to said longitudinal opening.

19. The developer apparatus of claim 11 wherein said flexible sheet-like inner liner is a polyester film.

20. The developer apparatus of claim 11 further including means to indicate the amount of toner remaining in the developer apparatus.

21. The developer apparatus of claim 20 wherein said indicating means comprises a coded film-like strip with visual indicia thereon movably mounted externally of one side wall of said housing, one end of said strip being attached to said winding means and thereby wound with said inner liner.

* * * * *